US005346223A

United States Patent [19]

Hamada et al.

[11] Patent Number: 5,346,223

[45] Date of Patent: Sep. 13, 1994

[54] THREAD WOUND GOLF BALL

[75] Inventors: Akihiko Hamada, Kakogawa; Akira Kato, Kobe, both of Japan

[73] Assignee: Sumitomo Rubber Industries, Ltd., Hyogo, Japan

[21] Appl. No.: 53,234

[22] Filed: Apr. 28, 1993

[30] Foreign Application Priority Data

Apr. 28, 1992 [JP] Japan ..... 4-135773

[51] Int. Cl.[5] ..... A63B 37/00

[52] U.S. Cl. ..... 273/227; 273/231; 273/235 R; 525/332.5; 525/331.1

[58] Field of Search ..... 525/332.5, 315, 332.7, 525/333.1, 333.2, 333.8, 387; 273/227, 225, 235 R, 226, 228; 260/998.14

[56] References Cited

U.S. PATENT DOCUMENTS 3,957,737 5/1976 Pautrat et al. ..... 525/333.2
4,064,922 12/1977 Farber et al. ..... 428/512
4,353,557 10/1982 Kajita et al. ..... 273/227
4,696,475 9/1987 Tomita et al. ..... 273/227

FOREIGN PATENT DOCUMENTS 55-161834 12/1980 Japan .
60072573 4/1984 Japan .
59-076236 5/1984 Japan .
2164260 9/1985 United Kingdom .
2232417 5/1990 United Kingdom .

*Primary Examiner*—James J. Seidleck
*Assistant Examiner*—Mark L. Warzel
*Attorney, Agent, or Firm*—Birch, Stewart, Kolasch & Birch

[57] ABSTRACT

The present invention provides a thread wound golf ball having excellent durability, heat resistance and impact resilience, which comprises a core, a thread rubber layer and an outer layer. A thread rubber constituting the thread rubber layer is obtained from a rubber latex blend containing a depolymerized high-cis polyisoprene rubber latex.

9 Claims, No Drawings

THREAD WOUND GOLF BALL

FIELD OF THE INVENTION

The present invention relates to a thread wound golf ball. More particularly, it relates to a thread wound golf ball comprising a thread rubber layer having high strength and excellent impact resilience. The resulting golf ball has excellent durability, heat resistance and impact resilience.

BACKGROUND OF THE INVENTION

A thread wound golf ball is a golf ball comprising a core (liquid core or solid core), a thread rubber layer formed by winding a thread rubber around the core in a stretched state and a cover for covering the thread rubber layer.

Generally, it is necessary that golf balls have suitable impact resilience so as to obtain excellent flight performances. Particularly, the thread wound golf ball requires a thread rubber having excellent impact resilience, because impact resilience of the ball is extremely influenced by a thread rubber layer and flight performance of the ball is extremely influenced by the properties of the thread rubber layer.

A thread rubber having excellent impact resilience can be obtained by vulcanizing a rubber blend comprising a low-cis polyisoprene rubber as a base rubber, but the low-cis polyisoprene rubber is inferior in mechanical strength and heat resistance. The thread rubber formed from the low-cis polyisoprene rubber imparts disadvantage to the resulting golf ball. That is, the thread rubber is liable to be damaged on forming the thread rubber layer by winding around the core at the stretched state, which is the cause of deterioration of durability of the ball. Further, heat upon forming the cover damages the thread wound layer, thus deteriorating ball compression.

Therefore, in order to improve the strength of thread rubber, it has been proposed to blend natural rubber or synthesized high-cis polyisoprene rubber in the low-cis polyisoprene rubber. However, impact resilience of the resulting golf ball adversely declines, although its strength is improved. It is therefor difficult to obtain both high impact resilience and high durability.

On the other hand, preparing the thread rubber from a coagulated sheet of a latex blend, the kneading process, wherein breakage of molecular chain occurs is unnecessary and therefore the above disadvantage in strength is slightly improved, but strength and impact resilience thereof are still insufficient.

As described above, in the thread wound golf ball, impact resilience of the ball is extremely influenced by the properties of the thread rubber constituting the thread rubber layer, whereby fly performances of the ball are extremely influenced. According to a prior art, when impact resilience is increased, strength is lowered and, therefore, the thread rubber having both high strength and excellent impact resilience has not been obtained.

OBJECTS OF THE INVENTION

Under these circumstances, the present inventors have intensively studied. As a result, it has been found that a thread wound golf ball having excellent durability, heat resistance and impact resilience can be obtained, by making a thread rubber from a rubber latex blend containing a depolymerized high-cis polyisoprene rubber latex and forming a thread rubber layer with the resulting thread rubber having good balance between high strength and impact resilience.

Main object of the present invention is to provide a thread wound golf ball comprising a thread rubber layer having high strength and excellent impact resilience, which have excellent durability, heat resistance and impact resilience.

This object as well as other objects and advantages of the present invention will become apparent to those skilled in the art from the following description.

SUMMARY OF THE INVENTION

According to the present invention, there is provided a thread wound golf ball comprising a core, a thread rubber layer formed on said core and a cover layer covering the thread rubber layer, the thread rubber constituting said thread rubber layer being obtained from a rubber latex blend containing a depolymerized high-cis polyisoprene rubber latex.

DETAILED DESCRIPTION OF THE INVENTION

The term "depolymerized high-cis polyisoprene rubber latex" used in the present invention means depolymerized natural rubber latex, depolymerized synthesized high-cis polyisoprene rubber latex or a mixture thereof. The depolymerized high-cis polyisoprene rubber latex is obtained by depolymerizing a natural rubber latex or synthesized high-cis polyisoprene rubber latex in the state of a latex, i.e. the state wherein the colloidal rubber is dispersed in water. The depolymerization can be conducted, for example, by heating in the presence of peroxides or azo compounds, or radical reaction due to a redox initiator under oxidizing atmosphere or in the presence of chain transfer agents or polymerization inhibitors, or irradiation (e.g. X ray, $\gamma$-ray, etc.) under the same conditions.

The depolymerization degree of the depolymerized latex is not specifically limited. For example, when the depolymerization degree is represented by an adhesiveness measured according to JIS-Z-1522 (adhesive cellophane tape test) or JIS-Z-1528 (double adhesive tape test) in the case of the natural rubber latex, the adhesion is preferably within the range of 25 g/2.5 cm to 300 g/2.5 cm.

When the adhesiveness of the rubber latex is smaller than 25 g/2.5 cm, an effect of improving impact resilience is not sufficient because of insufficient depolymerization degree. When the adhesiveness exceeds 300 g/2.5 cm, strength of thread rubber is liable to be deteriorated because of excessive depolymerization degree.

On depolymerization of the latex, the reaction proceeds with maintaining the state that rubber particles having a particle size of about $1\mu$ are dispersed and, therefore, depolymerization is preferentially arisen at a position close to the surface of the dispersed particles. At the same time, an isomerization reaction due to radicals proceeds and, to the contrary, the crosslinking reaction under oxygen free atmosphere proceeds preferentially in the inner portion of the particles to form a non-uniform reaction system. As described above, since the improvement of impact resilience due to depolymerization and that of strength due to the crosslinking reaction are simultaneously arisen, impact resilience is improved without deterioration of strength.

In the conventional kneading process, since the reaction proceeds with maintaining an uniform system on the mastication of the solid rubber, impact resilience is improved while strength is lowered. Substantially different from the above, depolymerization of the rubber latex can improve impact resilience without deterioration of strength.

The depolymerized high-cis polyisoprene rubber latex is commercially available, for example, Aoitex Softack M-M (medium depolymerization degree), Aoitex Softack H (high depolymerization degree), Aoitex Softack L (low depolymerization degree) manufactured by Aoi Rubber Co. These can be suitably used in the present invention.

To the rubber latex blend in the present invention, for example, natural rubber latex, synthesized high-cis polyisoprene rubber latex, synthesized low-cis polyisoprene rubber latex and the like can be added alone or in combination thereof, in addition to the above depolymerized high-cis polyisoprene rubber latex. On formulating the rubber latex, the amount of the depolymerized high-cis polyisoprene rubber latex is preferably not less than 10% by weight, particularly not less than 20% by weight, based on the dry weight of the rubber latex blend.

The rubber latex blend used on the preparation of the thread rubber can be obtained by adding vulcanization additives (e.g. vulcanizing agents, vulcanization accelerators, vulcanization auxiliaries, etc.), antioxidants, if necessary, small amount of fillers and oils to the rubber latex followed by mixing.

A non water-soluble liquid additive is emulsified in water and a non water-soluble solid powder is formed into a dispersion in water, and then they are added to the rubber latex to form a blend.

The additive may be anyone which is normally used in the rubber industry and non-limited examples thereof are as follows.

(1) Vulcanizing agent: organic sulfur compounds such as sulfur, dithiomorpholine, etc.
(2) Vulcanization accelerator aldehyde-aniline accelerators (e.g. butylaldehyde-aniline condensate, etc.) thiazol accelerators (e.g. M, DM, MZ, etc.) sulfenamide accelerators (e.g. CZ, NZ, etc.) thiurams (e.g. TT, TS, TET, etc.) dithiocarbamates (e.g. tepidon, EZ, BZ, etc.)
(3) Vulcanization auxilary: zinc oxide
(4) Antioxidant: bisphenols such as 2,2'-methylene-bis-(4-ethyl-6-t-butylphenol), 2,2'-methylene-bis-(4-methyl-6-t-butylphenol), etc.
(5) Filler: kaolin clay, calcium carbonate, barium sulfate, etc.
(6) Oil: naphthene oil, adipate plasticizer, etc.

The thread rubber in the present invention is made as follows. The rubber latex blend is coagulated on a endless belt with a solution of a coagulant (e.g. calcium chloride, calcium nitrate, etc.) and formed continuously to form a thin film which is rinsed with water and dried. Then, the dried film is vulcanized to form a continuous vulcanized rubber sheet which is cut into pieces of appropriate width.

Thereafter, the thread rubber thus obtained is wound around a core at the stretched state to form a thread wound layer which is then covered with a cover comprising an ionomer resin or trans-polyisoprene as a base material and then finished it with paint to obtain the thread wound golf ball of the present invention.

As the core, a conventional solid or liquid core can be used. The thickness of the thread rubber layer varies depending on a material of the cover and diameter of the core, but it is normally 4 to 8 mm.

EXAMPLES

The following Examples further illustrate the present invention in detail but are not to be construed to limit the scope thereof.

Examples 1 to 4 and Comparative Examples 1 and 2

In order to prepare a thread rubber, six kinds of rubber latex blends shown in Tables 1 and 2 were firstly prepared. Among these six kinds of rubber latex blends, blends 1 to 4 shown in Table 1 are used for preparing thread rubbers of the golf balls of Examples 1 to 4, and blends 5 and 6 shown in Table 2 are used for preparing thread rubbers of the golf balls of Comparative Examples 1 and 2.

In Tables 1 and 2, the unit of a numerical value of each component is dry parts by weight. Regarding latex, a rubber content is shown. Regarding accelerator (vulcanization accelerator), sulfur and antioxidant, an active component content is shown. The details as to each component are explained at the notes attached to Table 2.

TABLE 1

| | Blend 1 | Blend 2 | Blend 3 | Blend 4 |
|---|---|---|---|---|
| Aoitex Softack M-M (depolymerized natural rubber latex)*1 | 50 | 40 | 40 | — |
| Aoitex Softack H (depolymerized natural rubber latex)*2 | — | — | — | 40 |
| Dunlop C-60 (natural rubber latex)*3 | 50 | 50 | 60 | 60 |
| Maxplene IR (low-cis polyisoprene rubber latex)*4 | — | 10 | — | — |
| Accelerator (emulsion, active component: 20%)*5 | 1 | 1 | 1 | 1 |
| Sulfur (dispersion, active component: 50%) | 2 | 2 | 2 | 2 |
| Antioxidant (dispersion, active component: 50%)*6 | 1 | 1 | 1 | 1 |

TABLE 2

| | Blend 5 | Blend 6 |
|---|---|---|
| Aoitex Softack M-M (depolymerized natural rubber latex)*1 | — | — |
| Aoitex Softack H (depolymerized natural rubber latex)*2 | — | — |
| Dunlop C-60 (natural rubber latex)*3 | 100 | 100 |
| Maxplene IR (low-cis polyisoprene rubber latex)*4 | — | 50 |
| Accelerator (emulsion, active component: 20%)*5 | 1 | 1 |
| Sulfur (dispersion, active component: 50%) | 2 | 2 |
| Antioxidant (dispersion, active | 1 | 1 |

TABLE 2-continued

| | Blend 5 | Blend 6 |
|---|---|---|
| component: 50%)*6 | | |

(Note)
*1: Aoitex Softack M-M (trade name), depolymerized (medium degree) natural rubber latex (adhesion: 80 g/2.5 cm; rubber content: 53%), manufactured by Aoi Rubber Co.
*2: Aoitex Softack H (trade name), depolymerized (high degree) natural rubber latex (adhesion: 130 g/2.5 cm; rubber content: 53%), manufactured by Aoi Rubber Co.
*3: Dunlop C-60 (trade name), natural rubber latex stored by adding a large amount of ammonia (rubber content: 60%), manufactured by Malaysia Dunlop Estate Co.
*4: Maxplene IR (trade name), low-cis isoprene rubber latex (rubber content: 65%), manufactured by Sumitomo Seika Co.
*5: Accelerator, Noxelar 8 (trade name), butylaldehyde-aniline condensate, manufactured by Ohuchi Shinko Kagaku Kogyo Co.
*6: Antioxidant, Yoshinox 425 (trade name), 2,2'-methylene-bis-(4-ethyl-6-t-butylphenol), manufactured by Yoshitomi Seiyaku Co.

The above latex blends 1 to 6 were placed on an endless belt on which a coagulant solution (calcium chloride solution) was applied to coagulate on the belt, respectively. The coagulated sheet thus obtained was rinsed with water and dried. Then, it was rolled round a drum and placed in a vulcanizer to vulcanize at 140° C. for 2 hours.

Thus, a vulcanized rubber sheet of 350 mm in width, 0.54 mm in thickness and about 30 m in length was prepared and the resulting vulcanized rubber sheet was cut in pieces of 1.6 mm in width to prepare a thread rubber.

The thread rubber thus obtained was wound around a solid core of vulcanized polybutadiene rubber [outer diameter: 28.5mm; hardness: 80 (JIS-A); weight: 18.2 g] at the stretched state to form a thread wound core of about 40 mm in outer diameter, which was covered with an outer layer material of a mixture comprising 100 parts by weight of ionomer resin and 2 parts by weight of titanium oxide to form an outer layer. After pretreatment, paint mark was provided to produce a thread wound golf ball of 42.7 mm in outer diameter.

The ionomer resin used on the formation of the outer layer is a mixture of HI-MILAN 1706, HI-MILAN 1605, HI-MILAN 1557 and HI-MILAN 1555 manufactured by Mitsui Du Pont Polychemicals Co. (weight ratio=45:40:5:10). The weight of the resulting thread wound golf ball was in the range of 45.4 to 45.6.

Ball properties (compression, initial velocity, durability and heat resistance) of the thread wound golf ball thus obtained are shown in Tables 3 and 4, together with a kind of the blend of the thread rubber. The measuring method of the ball properties are explained in detail at the notes attached to Table 4.

TABLE 3

| | Ex. 1 | Ex. 2 | Ex. 3 | Ex. 4 |
|---|---|---|---|---|
| Blend of thread rubber | Blend 1 | Blend 2 | Blend 3 | Blend 4 |
| Compression (PGA system) | 85 | 85 | 85 | 85 |
| Initial velocity (feet/second)*7 | 252.7 | 253.0 | 252.3 | 253.0 |
| Durability (index)*8 | 140 | 138 | 142 | 137 |
| Heat resistance (compression deterioration point)*9 | −9 | −11 | −8 | −11 |

TABLE 4

| | Comp. Ex. 1 | Comp. Ex. 2 |
|---|---|---|
| Blend of thread rubber | Blend 5 | Blend 6 |
| Compression (PGA system) | 85 | 85 |
| Initial velocity (feet/second)*7 | 248.0 | 252.5 |
| Durability (index)*8 | 140 | 100 |
| Heat resistance (compression deterioration point)*9 | −9 | −18 |

(Note)
*7: It is measured by R & A method.
*8: A golf ball is allowed to bump at a speed of 45 m/second, repeatedly. The number of times at which the ball is broken is determined. The number is expressed as an index when the number of Comparative Example 2 is made 100.
*9: A golf ball is aged in an oven at 70° C. for 72 hours. Difference between compression after aging and initial compression is expressed as a value of PGA system. The minus value indicates that compression is deteriorated.

As is shown in Table 3, regarding the golf balls of Examples 1 to 4, the index which indicates durability was large and the initial velocity was also large. The golf balls had excellent durability and impact resilience.

To the contrary, regarding the golf ball of Comparative Example 1 comprising only a natural rubber as the base component, the index which indicates durability was large and durability was excellent, but the initial velocity was small and in, pact resilience was extremely deteriorated, as shown in Table 4. Regarding the golf ball of Comparative Example 2 comprising a mixture of natural rubber and low-cis polyisoprene rubber as the rubber component, the initial velocity was large and impact resilience was excellent, but the index which indicates durability was small and durability was inferior in comparison with others, as shown in Table 4.

The golf balls of Examples 1 to 4 showed small compression deterioration point in comparison with that of Comparative Example 2 and heat resistance was excellent.

As described above, a thread wound golf ball having excellent durability, heat resistance and impact resilience can be obtained, by making a thread rubber layer from a rubber latex containing a depolymerized high-cis polyisoprene rubber latex which has a good balance between high strength and impact resilience.

What is claimed is:

1. A thread wound golf ball comprising a core, a thread rubber layer formed on said core and a cover layer covering the thread rubber layer, the thread rubber constituting said thread rubber layer being obtained from a rubber latex blend comprising a depolymerized high-cis polyisoprene rubber latex.

2. The thread wound golf ball according to claim 1 wherein said depolymerized high-cis polyisoprene latex has an adhesiveness of 25 to 300 g/2.5 cm.

3. The thread wound golf ball according to claim 1 wherein said rubber latex blend comprises not less than 10% by weight of the depolymerized high-cis polyisoprene rubber latex.

4. The thread wound golf ball according to claim 1 wherein said rubber latex blend comprises natural rubber latex, synthesized high-cis polyisoprene rubber latex, synthesized low-cis polyisoprene rubber or a mixture thereof, in addition to the depolymerized high-cis polyisoprene rubber latex.

5. The thread wound golf ball according to claim 1 wherein said rubber latex blend further comprises vulcanizing agents, vulcanization accelerators, vulcanization auxiliaries, antioxidants, fillers and oils.

6. The thread wound golf ball according to claim 1 wherein said thread rubber is prepared by coagulating said rubber latex blend with a coagulant to form a thin film and vulcanizing to form a vulcanized rubber sheet which is cut into pieces.

7. The thread wound golf ball according to claim 1 wherein said core is made from rubber or liquid.

8. The thread wound golf ball according to claim 1 wherein said cover is made from an ionomer resin or trans-polyisoprene.

9. The thread wound golf ball according to claim 1 wherein said rubber layer has a thickness of 4 to 8 mm.

* * * * *